US007588318B2

(12) United States Patent
O'Hara et al.

(10) Patent No.: US 7,588,318 B2
(45) Date of Patent: Sep. 15, 2009

(54) SYSTEM AND METHOD FOR ASSURING PROPER PEN LOADING

(75) Inventors: Steve O'Hara, Camas, WA (US); Scott D. Sturgeon, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/114,232

(22) Filed: May 2, 2008

(65) Prior Publication Data

US 2008/0204508 A1 Aug. 28, 2008

Related U.S. Application Data

(62) Division of application No. 11/044,122, filed on Jan. 27, 2005, now Pat. No. 7,380,904.

(60) Provisional application No. 60/586,425, filed on Jul. 7, 2004.

(51) Int. Cl.
*B41J 2/14* (2006.01)
*B41J 2/16* (2006.01)

(52) U.S. Cl. ..... 347/49; 347/86

(58) Field of Classification Search ..... 347/37, 347/49, 50, 84–87; 400/55, 58, 59
See application file for complete search history.

(56) References Cited

U.S. PATENT DOCUMENTS

| | | | | |
|---|---|---|---|---|
| 5,629,725 | A | 5/1997 | Buican | |
| 5,642,143 | A | 6/1997 | Rhoads | |
| 5,646,665 | A | 7/1997 | Swanson et al. | |
| 6,145,975 | A | 11/2000 | Kotaki et al. | |
| 6,296,345 | B1 | 10/2001 | Kline et al. | |
| 6,302,535 | B1 | 10/2001 | Sturgeon et al. | |
| 6,471,334 | B2 | 10/2002 | Kline et al. | |
| 6,488,369 | B1 * | 12/2002 | Steinmetz et al. | 347/86 |
| 6,494,630 | B2 | 12/2002 | Williams et al. | |

* cited by examiner

*Primary Examiner*—Juanita D Stephens

(57) ABSTRACT

An inkjet pen includes an internal ink supply; and at least one datum feature configured to engage and slide over a guide track in a pen carriage during installation of the pen in the carriage. The at least one datum feature is configured to interact with corresponding datum features of the guide track to prevent improper installation of the pen in the carriage.

16 Claims, 8 Drawing Sheets

SYSTEM AND METHOD FOR ASSURING PROPER PEN LOADING

RELATED APPLICATIONS

This application is a divisional of, and claims the priority under 35 U.S.C. § 120 of, previously-filed U.S. patent application Ser. No. 11/044,122, now issued U.S. Pat. No. 7,380,904, entitled "System and Method for Assuring Proper Pen Loading," filed Jan. 27, 2005, which application further claimed the priority under 35 U.S.C. § 119(e) of U.S. Provisional Application No. 60/586,425, entitled "System and a method for assuring proper pen loading," filed Jul. 7, 2004. Both of these previous applications are incorporated herein by reference in their respective entireties.

BACKGROUND

Printers such as ink-jet printers employ printing elements which require periodic removal and replacement. In the case of inkjet printers, the printing elements include nozzle arrays typically mounted on pens or print cartridges, and can require periodic replacement as the nozzle array wears out, becomes clogged, or when an internal ink supply becomes exhausted.

In the past, the user has manually inserted and removed the inkjet pens or print cartridges on the printer. As users are allowed to independently insert and remove the inkjet pens and print cartridges, a number of challenges have become manifest. Challenges facing designers of inkjet printers include difficulty in guiding the inkjet pens into an associated carriage, confusion about the color of pen to be installed in each carriage, and the proper orientation of the pen when being inserted into the carriage.

Traditionally, frontward insertion was not smooth with many inkjet carriage designs. Often, the inkjet pen would hit a hard stop before having to be wiggled into position. Traditional printers attempted to the frontward insertion of the inkjet pens with illustrations contained with the pen and the printer lid aimed at preventing incorrect insertion.

Similarly, solutions aimed at preventing inappropriate or forced color swapping were traditionally limited to the inclusion of illustrative features on the pen lid. While illustrations are helpful to some users, the inkjet pen could still be inserted deep into a wrong f of the carriage, and in some cases the inkjet pen could be pushed to the point of getting stuck, resulting in the need to replace these printers. Additionally, inappropriate color swapping could cause damage to the carriage latch mechanism due to varying pen design.

Backwards insertion also causes dissatisfaction to customers and potential damage to printers. Similar to the previous situations, traditional methods for preventing incorrect insertion included modifying features on the pen lid to further inform the user of correct pen insertion. However, this did not in any way prevent the pen from being incorrectly plugged deep into the cavity where potentially expensive damage could result.

SUMMARY

An inkjet printer assembly includes an inkjet carriage assembly having a plurality of side walls and an end wall, the inkjet carriage assembly including a pen guide track extruding from at least one of the side walls and a plurality of datum features formed in the inkjet carriage assembly, and an inkjet dispenser pen having a body, the inkjet dispenser including one or more datum extrusions formed on the body, wherein the one or more datum extrusions are associated with the datum features to assure proper loading of the inkjet dispenser pen into the inkjet carriage assembly.

Additionally, a method for assuring proper loading of an inkjet dispenser pen includes placing complementary surfaces of an inkjet dispenser pen in contact with a datum structure of a carriage assembly, wherein the datum structure of the carriage assembly includes a plurality of datum extrusions configured to assure correct insertion of the inkjet dispenser pen.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A number of exemplary systems and methods for assuring proper loading of an inkjet pen into the carriage apparatus of an inkjet fluid dispenser are disclosed herein. More specifically, a plurality of datum features are added to the inkjet pen body and to the carriage assembly of an inkjet fluid dispenser to improve the front loading of the pens into a carriage, to fool proof the swapping of color and black pens by a user, and to enhance the fool proofing of backwards insertion by a user. That is, according to one exemplary embodiment, the novel datum features of the inkjet pen work in conjunction with a number of datum features of the printer carriage assembly to assure proper loading of the pen into the inkjet fluid dispenser. Details of the exemplary systems and methods will be explained in further detail below.

As used in the present specification and the appended claim, the term "jettable fluid" is meant to be understood broadly as any fluid composition that is configured to be selectively emitted from an inkjet dispenser. Additionally, the term "datum" is meant to be understood broadly as any reference surface or other point of reference against which measurements can be made and proper installation can be measured or enhanced.

In the following description, for purposes of explanation, numerous specific details are set forth in order to provide a thorough understanding of the present system and method for assuring proper pen loading in a carriage component. It will be apparent, however, to one skilled in the art, that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
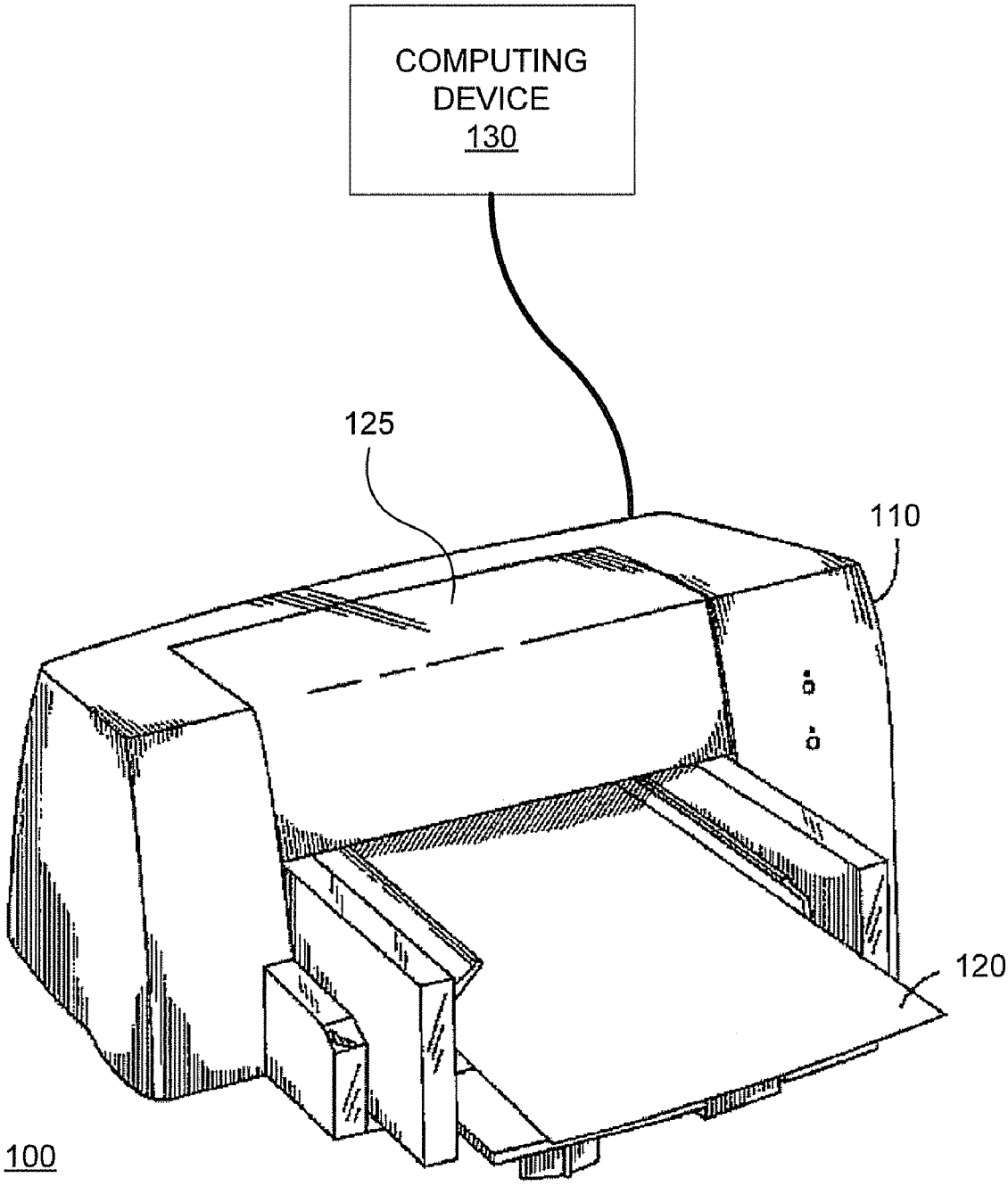
FIG. 1 is a perspective view illustrating an exemplary inkjet printer.

FIG. 1 illustrates an exemplary inkjet printer (100) configured to incorporate the present system and method. As show in FIG. 1, the exemplary inkjet printer (100) includes a housing (110) and a print medium (120) disposed on the housing (110). Additionally, the exemplary inkjet printer (100) includes a pivoting access cover (125) forming a portion of the housing (110). The housing (110) of the exemplary inkjet printer (100) illustrated in FIG. 1 may be any shape or size sufficient to house an inkjet fluid dispenser and any associated carriage or hardware used to perform a fluid dispensing operation. The housing (110) may contain one or more fluid dispensers, print medium positioning rollers or belts, servo mechanisms, and/or computing devices such as a microprocessor. The print medium (120) used in connection with the present exemplary inkjet printer (100) may be any type of suitable printable sheet material such as paper, card-stock, transparencies, Mylar, and the like. However, for convenience only, the illustrated embodiments described in the context of using paper as the exemplary print medium (120).

As illustrated in FIG. 1, the inkjet printer (100) may be communicatively coupled to a computing device (130) configured to communicate print commands in the form of a print job to the inkjet printer. The inkjet printer (100) may receive the print job from the communicatively coupled computing device (130) wherein the print job includes a digital description of a desired image. The print job may be converted into motion and dispensing commands that are then be used by the inkjet printer (100) to deposit image forming fluid onto the print medium (120) to create a desired image.

Figure 2:
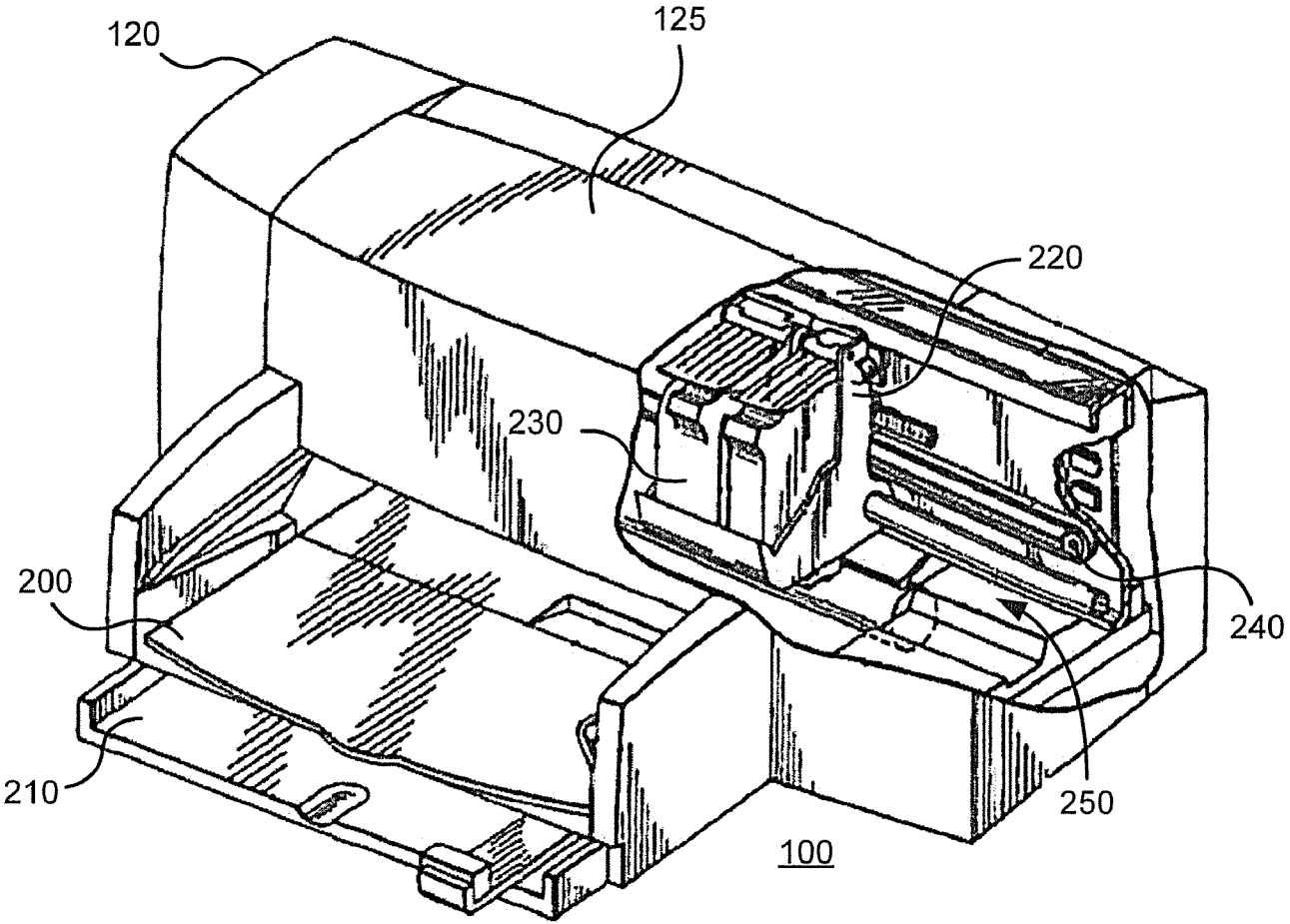
FIG. 2 is a partially cut-away perspective view illustrating the internal components of an exemplary inkjet printer.

FIG. 2 is a schematic perspective view further illustrating the internal components of the exemplary inkjet fluid printer (100). As illustrated in FIG. 2, the inkjet fluid printer (100) includes a media feed tray (200) and a print job reception tray (210). According to one exemplary embodiment, the media feed tray is configured to house a specified quantity of print medium (120; FIG. 1) until it is drawn into the inkjet fluid printer (100) to receive a desired image. As illustrated in FIG. 2, the print medium (120; FIG. 1) may be drawn into the inkjet fluid printer (100) and into a print zone (250). Once a print job has been performed, the print medium (120; FIG. 1) is expelled from the inkjet fluid printer (100) into the print job reception tray (210) where it may be accessed by a user.

The internal components of the inkjet fluid printer (100) that are adjacent to the print zone (250) are also illustrated in FIG. 2. As illustrated, the inkjet fluid printer (100) includes a carriage assembly (220) housing a number of inkjet pens (230). Additionally, as illustrated in FIG. 2, the carriage assembly (220) is moveably coupled to the inkjet fluid printer (100) by a number of servo/stepper mechanisms (240). According to one exemplary embodiment, the servo/stepper mechanisms are configured to selectively position the carriage assembly (220) over the print zone (250) where jettable fluid is selectively dispensed onto a print medium (120; FIG. 1) during a print operation. The servo/stepper mechanisms (240) may include, but are in no way limited to, rollers, belts, shafts, motors, gears, solenoids, actuators, and the like.

As mentioned above, the present inkjet printer (100) is configured to selectively dispense jettable fluid from a number of inkjet pens (230) onto a print medium (120; FIG. 1). However, inkjet pens (230) contain a limited quantity of jettable fluid. Due to the limited quantity of jettable fluid, the inkjet pens (230) are often replaced. The inkjet pent (230) may be replaced by either a front-loading or a top loading operation. Faulty replacement of the inkjet pens (230) many times results in frustration to the user and potential damage to the inkjet fluid printer (100). Consequently, the present exemplary systems and methods include a number of elements that reduce and/or prevent the likelihood of erroneous insertion of an inkjet pen (230) into either a front loading or a top loading carriage. While the exemplary elements disclosed herein are described in the context of a thermal or piezoelectric inkjet pen, the thermal inkjet pen may be any removable inkjet pen capable of performing print on demand applications including, but in no way limited to, thermally actuated inkjet fluid dispensers, mechanically actuated inkjet fluid dispensers, electrostatically actuated inkjet fluid dispensers, magnetically actuated fluid dispensers, and/or piezoelectrically actuated fluid dispensers.

Figure 3:
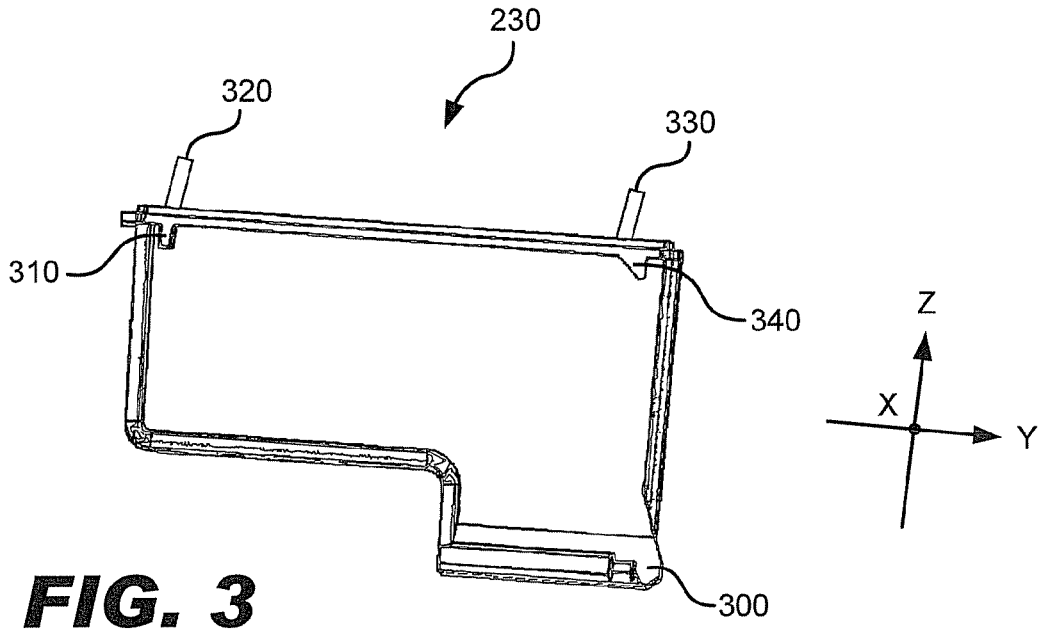
FIG. 3 is a side view illustrating the components of an exemplary inkjet pen.

FIG. 3 illustrates an exemplary inkjet pen (230) having a number of insertion members configured to reduce and/or prevent the likelihood of erroneous insertion of the inkjet pen. As illustrated in FIG. 3, the inkjet pen (230) includes a Y datum feature (300) formed in a bottom surface of the inkjet pen. As shown, the Y datum feature is formed in the surface of the inkjet pen and includes an orifice or a groove configured to receive a corresponding carriage datum feature, as will be illustrated below with reference to FIG. 4. The Y datum feature (300) is meant to receive a corresponding datum feature formed in an exemplary carriage assembly, thereby precisely and correctly situating and securing the Y position of the inkjet pen (230). While specific attention is given herein to the Y datum feature (300) of the exemplary inkjet pen (230), a number of X and Z datum features may also be formed on the body of the exemplary inkjet pen according to the present systems and methods.

For ease of reference to FIG. 3 and subsequent Figures, the following description is expressed with reference to an X, Y, and Z coordinate system. This system is described with reference to the origin being at the center of a properly inserted inkjet pen wherein the Y axis represents the direction of insertion. Although, the X, Y, and Z axis are described herein as orthogonal (such as in rectangular coordinates), other axes could be used that are non-orthogonal such as with a cylindrical or polar coordinate system.

Continuing with FIG. 3, a plurality of extrusions (320, 330) are illustrated as being coupled to or formed in the upper surface of the inkjet pen (230) in the Z direction. According to the exemplary inkjet pen (230) illustrated in FIG. 3, a color keying member (340) is extruded from a side surface of the inkjet pen on the front or positive Y portion of the inkjet pen. The color keying member (340) of the inkjet pen (230) is configured to be a point of contact for a guide or a track system associated with a carriage assembly, as will be further developed below. According to one example, the color keying member (340) is configured to follow a guide, thereby directing the path of travel, as well as the resulting position of the inkjet pen (230) during installation. FIG. 3 also illustrates a color keying stop (330) disposed on top of the inkjet pen (230) substantially adjacent to the color key member (340). The color keying stop (330) is an extrusion extending from the top of the inkjet pen (230) in a positive Z direction. According to one exemplary inkjet pen (230) construction, the length and position of the color keying stop (330) in relation to the color keying member (340) may vary depending on whether the inkjet pen is a color or monochromatic inkjet pen (230).

A number of extrusions are also present on the negative Y portion of the inkjet pen (230). As illustrated in FIG. 3, the inkjet pen (230) includes a backward insertion member (310) and a backward insertion stop (320) extruding in the positive Z direction. The backward insertion member (310) is configured to ride on a guide during the insertion of the inkjet pen (230). The backward insertion stop (320), disposed adjacent to the backward insertion member (310), is configured to establish a backwards datum height that spans from the bottom of the backward insertion member (310) to the top of the backward insertion stop (320). According to the exemplary inkjet pen (230) configuration illustrated in FIG. 3, the backwards datum height is configured to cause an interference fit in a corresponding carriage assembly when inserted backwards, as will be further explained in detail below with reference to FIG. 12. The interference fit produced by the backward insertion stop (320) will provide immediate feedback to a user by resisting a potentially damaging backward insertion of the inkjet pen (230).

Figure 4:
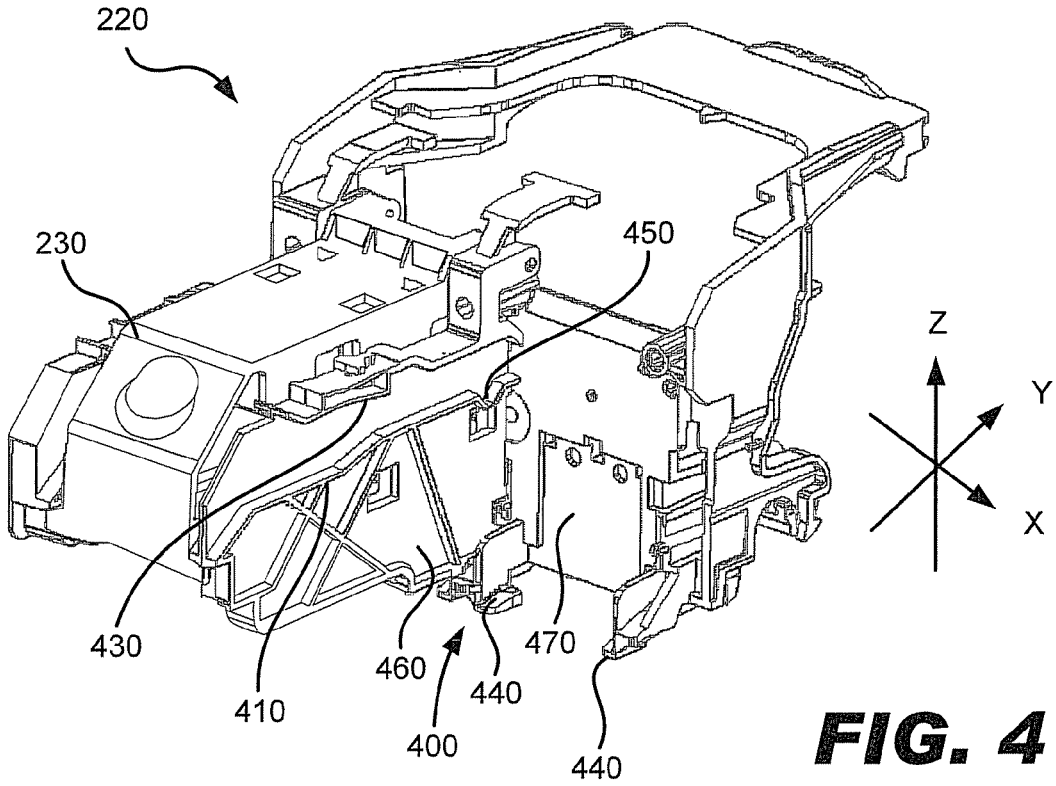
FIG. 4 is a partially cut-away perspective view illustrating an exemplary carriage assembly.

FIG. 4 is a partially cut-away perspective view of an exemplary carriage assembly (220) having one inkjet pen (230) disposed therein. As illustrated in FIG. 4, the exemplary carriage assembly (220) includes a pen cavity (400) bounded on a plurality of sides by the carriage assembly (220). As shown, a number of functional elements are formed in the side walls (460) of the carriage assembly (220) to prevent or reduce the likelihood of an erroneous insertion of an inkjet pen (230). The exemplary functional elements formed in the side walls (460) of the carriage assembly (220) include, but are in no way limited to, a plurality of carriage datum features (440), a pen guide track (410), a backwards installation member (430), and a number of color keying track depressions (450).

The pen cavity (400) formed in the carriage assembly (220) is configured to readily receive a properly inserted inkjet pen (230). As illustrated in the exemplary carriage assembly (220) of FIG. 4, a plurality of carriage datum features (440) are extruded from the side walls (460) near the end wall (470) of the carriage assembly (220). According to the exemplary carriage assembly (220) illustrated in FIG. 4, the carriage datum features (440) are configured to receive at least a corresponding Y datum feature (300; FIG. 3) of a properly inserted inkjet pen (230) and securely couple the inkjet pen at a proper Y location until removal is desired. According to the exemplary carriage assembly illustrated in FIG. 4, the carriage datum features (440) include a plurality of lateral extrusions extending from the side walls (460) of the carriage assembly (220) into the pen cavity (400) at a desired Y location of the exemplary carriage assembly (220). While the exemplary carriage assembly (220) illustrated in FIG. 4 shows the carriage datum features (440) as having an inclined cross-section leading to a 90 degree drop off or lip, any extruded shape may be implemented as the carriage datum features (440) with a corresponding mating shape being formed in the Y datum feature (300; FIG. 3) of an inkjet pen (230).

FIG. 4 also illustrates an exemplary guide track (410) that forms a portion of the side wall (460). The exemplary guide track (410) is associated with the color keying member (340; FIG. 3) of the inkjet pen (230) illustrated above. According to the exemplary carriage assembly (220) illustrated in FIG. 4, the guide track (410) includes an extruded ridge extending in the positive Y direction while varying in elevation in the positive Z direction. The guide track (410) spans a substantial portion of the side wall (460) to aid in the insertion and translation of a pen (230) in the pen cavity (400). According to one exemplary carriage assembly (220), the guide track (410) is configured to facilitate a smooth insertion of a pen (230) by slideably receiving the color keying member (340; FIG. 3) of the inkjet pen (230) and guiding the pen into a desired position within the pen cavity (400). A color keying track depression (450) is also formed in the guide track (410) in the exemplary carriage assembly (220) illustrated in FIG. 4. The color keying track depression (450) is a depression formed in the guide track in the negative Z direction. As shown, the dimensions and the relative location of the color keying track depression (450) in the guide track (410) may be adjusted by the manufacturer to correspond with a color keying member (340) located on the pen (230).

A backwards installation member (430) is also be formed on the sidewall (460) portion of the exemplary carriage assembly (220) illustrated in FIG. 4. The backwards installation member (430) is an extrusion formed in the sidewall (460) of the present exemplary carriage assembly (220) configured to selectively restrict the amount of passable distance between the profile of the guide track (410) and an upper surface. According to the exemplary carriage assembly illustrated in FIG. 4, the backwards installation member (430) may form an upper surface by which an inserted pen must pass during installation. As shown, the backwards installation member (430) extends toward the guide track (410) to only permit pens (230) having the appropriately positioned color keying stops (330; FIG. 3) and members (340; FIG. 3) to pass, while causing an interference fit that prevents the passage of a backward insertion stop (320; FIG. 3) and/or a backward insertion member (310; FIG. 3).

Figure 5:
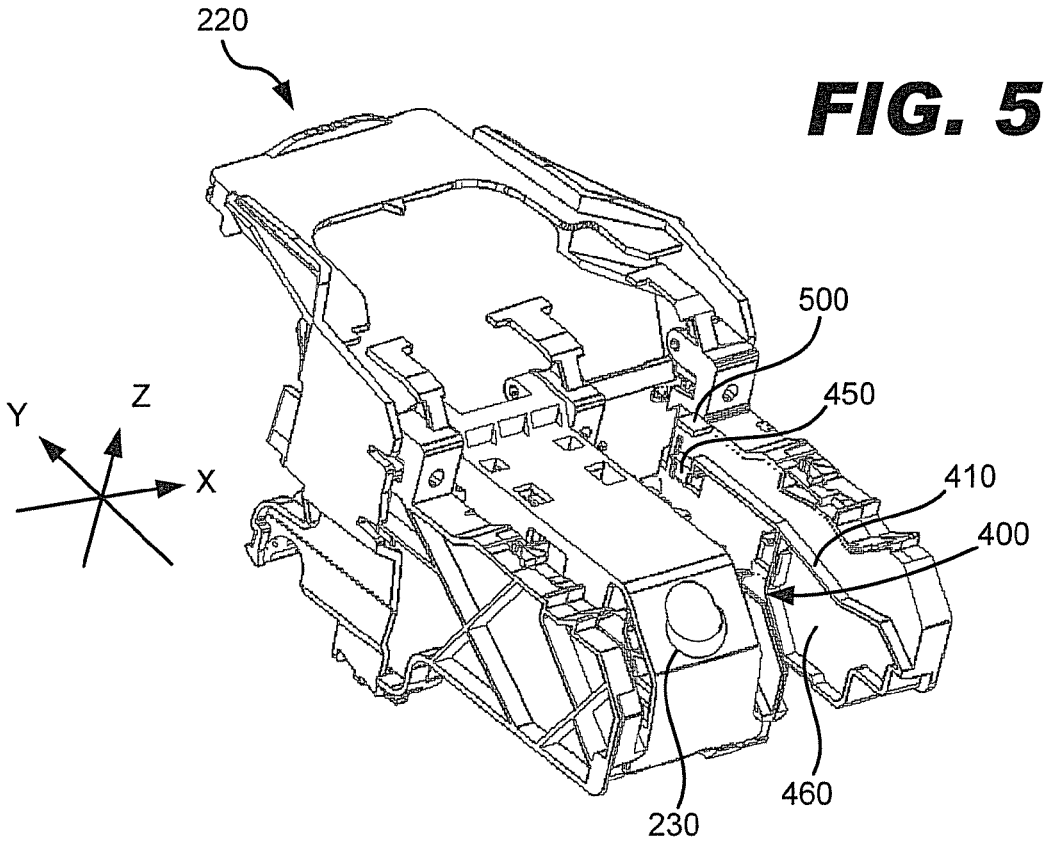
FIG. 5 is a perspective view illustrating the components of an exemplary carriage assembly.

FIG. 5 further illustrates a number of components of the present exemplary carriage assembly (220). As illustrated in FIG. 5, a color key extrusion (500) in the form of an extruding member may be formed on the sidewall (460) of the exemplary carriage assembly (220). According to one exemplary carriage assembly (220), the color key extrusion (500) is selectively extruded relative to the color keying track depression (450) of the guide track (410). Accordingly, the size, shape, and relative orientation of the color keying track depression (450) and the color key extrusion (500) may be modified to selectively accept a desired color keying member (340; FIG. 3) and an associated color keying stop (330; FIG. 3), while preventing the unrestricted passage of undesired color keying stops (330; FIG. 3). According to one exemplary configuration, an undesired color keying stop (330; FIG. 3) will be positioned relative to its corresponding color keying member (340; FIG. 3) to produce an interference fit when passed by the color key extrusion (500) of the carriage assembly (220). Accordingly, when a user attempts to insert an inkjet pen (230; FIG. 3) being filled with a wrong color or a wrong fluid type, the relative position of the color keying stops (330; FIG. 3) and the color keying extrusion (500) will generate an interference and a hard stop during insertion, thereby notifying the user of an erroneous fit.

Figure 6:
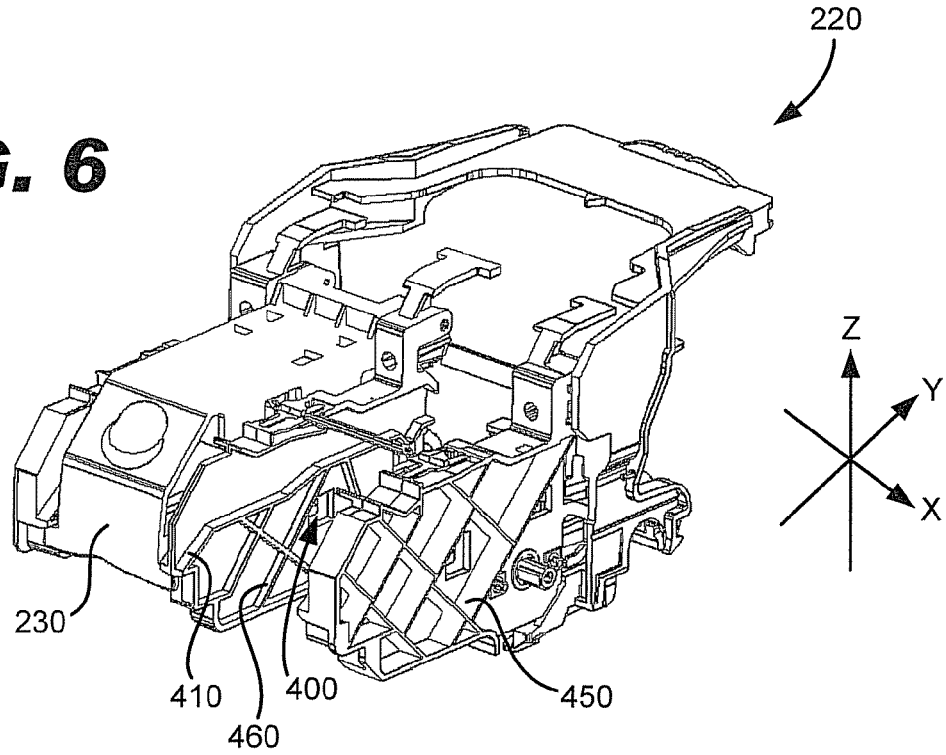
FIG. 6 is a perspective view illustrating the components of an exemplary carriage assembly.

FIG. 6 further illustrates a perspective view of one exemplary carriage assembly (220). As illustrated in FIG. 6, a plurality of sidewalls (460) form a pen cavity (400) that is configured to receive an inkjet pen (230; FIG. 3). As mentioned previously, the guide track (410) and other components of the exemplary carriage assembly (220), in conjunction with formed insertion components of the inkjet pen (230; FIG. 3) provide for improved front loading of inkjet pens into the pen cavity (400) of the carriage assembly, thereby fool proofing the swapping of color and black pens by a customer, and enhancing the fool proofing of backwards insertion by the customer.

Exemplary Implementation and Operation

Figure 7:
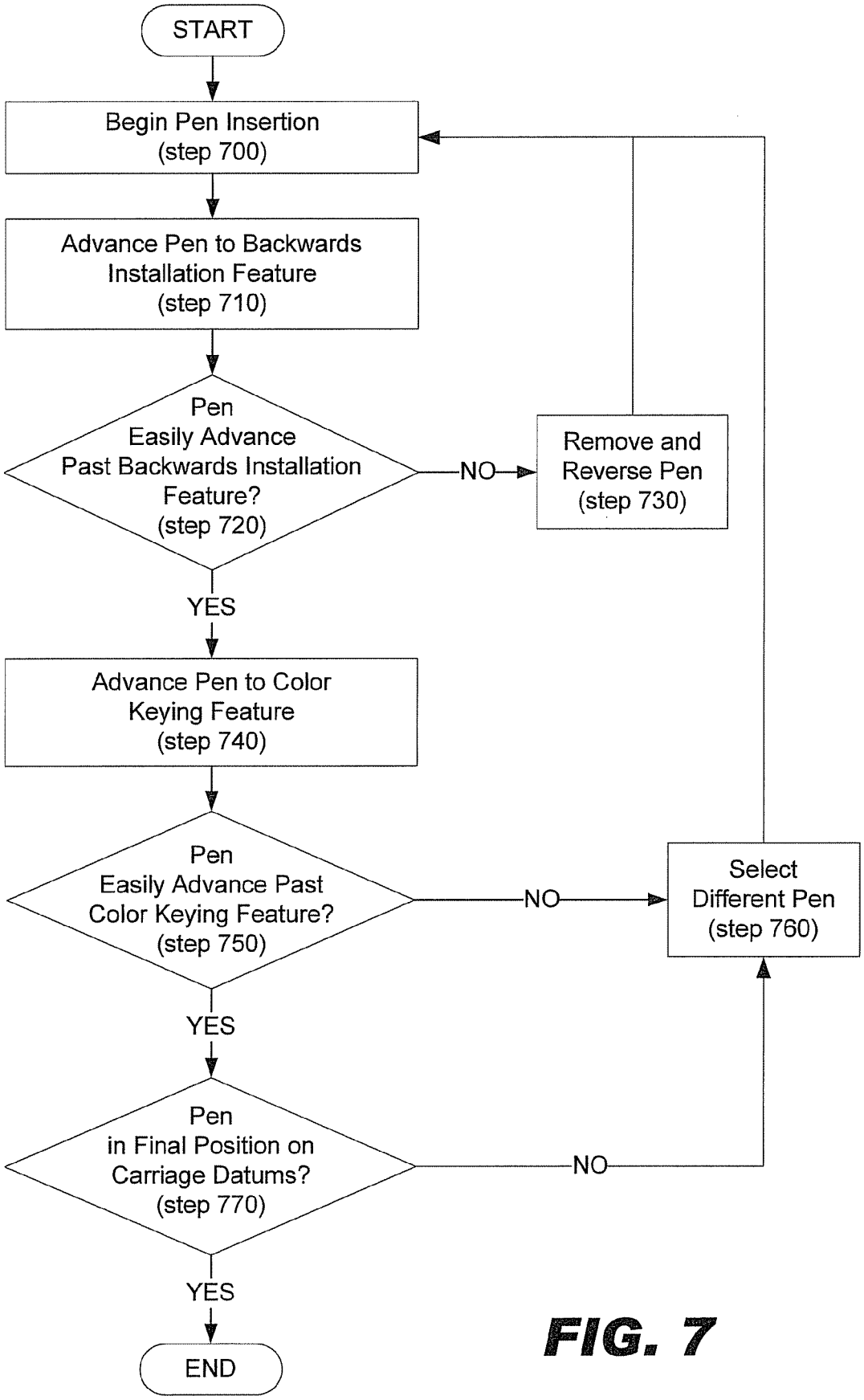
FIG. 7 is a flow chart illustrating an exemplary method for inserting an inkjet pen into an exemplary carriage assembly.

FIG. 7 illustrates an exemplary method for inserting an inkjet pen into an exemplary carriage assembly. As shown in FIG. 7, the present exemplary method begins by first beginning the insertion of an inkjet pen into an exemplary carriage assembly (step 700). Once started on the guide track, the pen is then advanced until it is placed adjacent to the backwards installation features of the exemplary carriage assembly (step 710). Once adjacent to the backwards installation features of the exemplary carriage assembly, a user may determine immediately whether the current inkjet pen can be easily advanced past the backwards installation features (step 720). If the inkjet pen cannot be easily advanced beyond the backwards installation feature (NO, step 720), a backwards loading of the inkjet pen is indicated and the pen should be removed and reversed (step 730) prior to further insertion (step 700). If, however, the inkjet pen is easily advanced beyond the backwards installation feature (YES, step 720), the inkjet pen may be further advanced along the guide track into the carriage assembly until it meets the color keying feature (step 740). Once in contact with the color keying feature, a user may determine whether the inkjet pen is easily advanced past the color keying feature (step 750). If the inkjet pen is not easily advanced past the color keying feature (NO; step 750), the inkjet pen does not correspond to the carriage assembly and another inkjet pen should be selected (step 760) and inserted into the carriage assembly. If, however, the inkjet pen easily advances past the color keying feature (YES, step 750), an inkjet pen containing the correct color of jettable fluid is being inserted and the pen may be advanced into its final position on the carriage datums (step 770). If the inkjet pen does not rest properly on the carriage datums (NO, step 770), a different pen should be selected (step 760) and installed. If, however, the pen is able to rest in the final position on the carriage datums (YES, step 770), the correct inkjet pen is properly installed into the carriage assembly and the insertion process is complete. Further details of the above-mentioned exemplary method will now be described in further detail below with reference to FIGS. 7 through 12.

Figure 8:
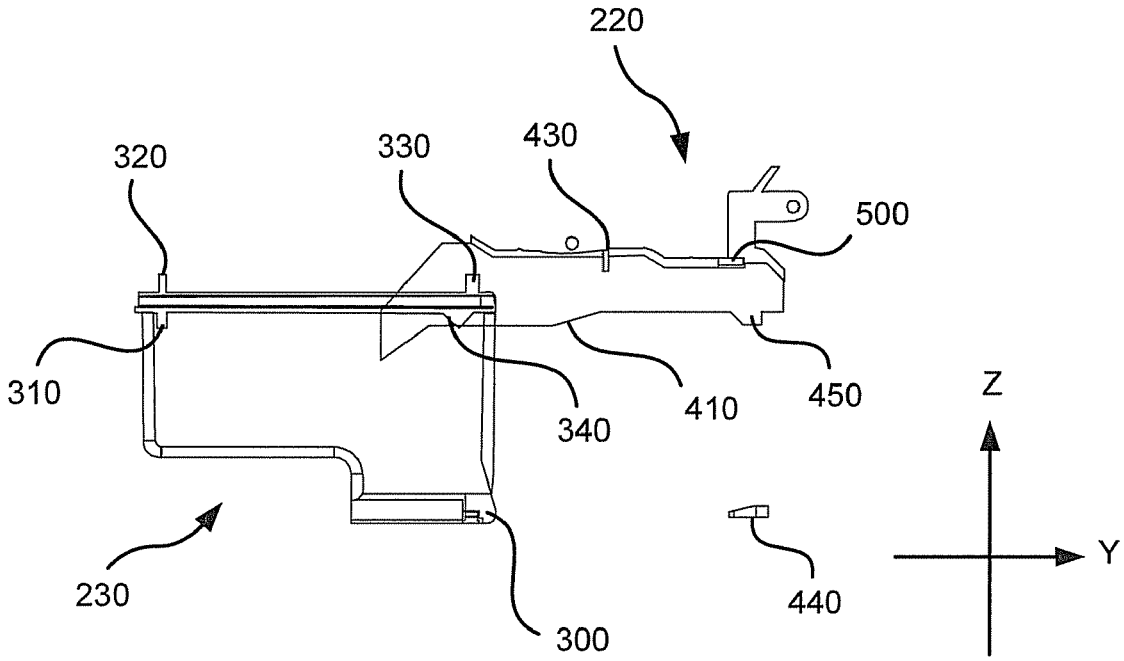
FIG. 8 is a side view illustrating an exemplary method for inserting an inkjet pen into an exemplary carriage assembly.

As illustrated in FIG. 7, the present method begins by presenting a desired inkjet pen (230; FIG. 2) to a carriage assembly (220; FIG. 2) and beginning the insertion of the pen (step 700). FIG. 8 illustrates the start of an exemplary insertion of the inkjet pen (230) into a carriage assembly (220). As shown in FIG. 8, the insertion of the inkjet pen (230) into a carriage assembly (220) is initiated by placing the color keying member (340) on the pen guide track (410). As mentioned previously, the color keying member (340) is extruded from the side of the desired inkjet pen (230; FIG. 2) such that it may be slideably coupled to the inwardly extruding pen guide track (410). According to this exemplary configuration, the profile of the pen guide track is configured to modify the Z position of the inkjet pen (230) as the inkjet pen is translated in the positive and/or negative Y direction.

Figure 9:
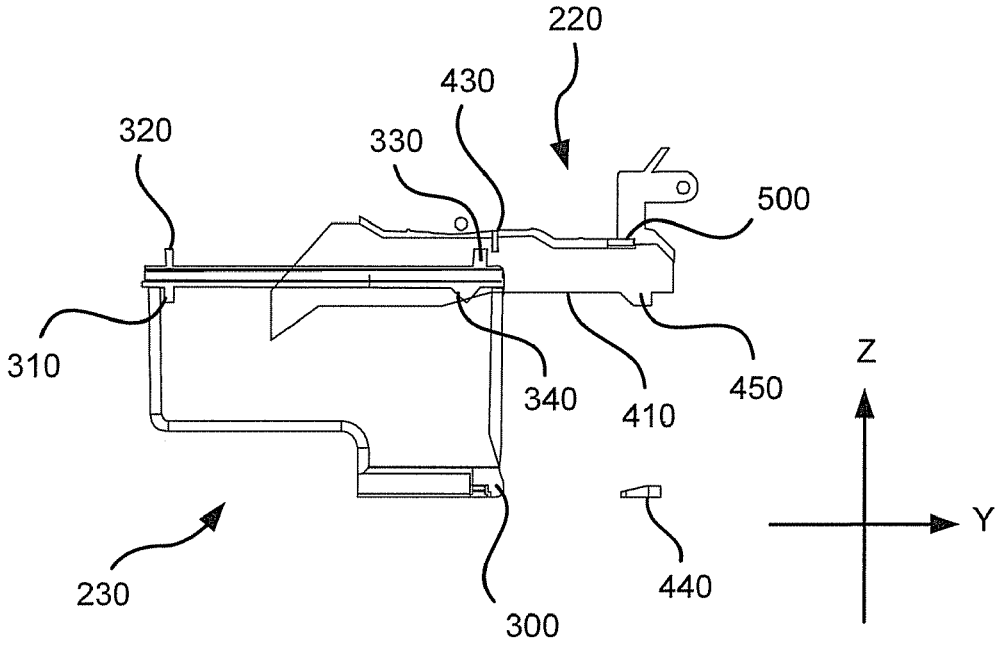
FIG. 9 is a side view illustrating an exemplary method for inserting an inkjet pen into an exemplary carriage assembly.

As the color keying member (340) is slideably translated across the pen guide track (410), the color keying stops (330) and members (340) will first encounter the backwards installation member (step 710; FIG. 7), as illustrated in FIG. 9. According to the exemplary carriage assembly (220) illustrated in FIG. 9, the backwards installation member (430) extruding down from the carriage assembly (220) towards the pen guide track (410) restricts the height of the passage along the pen guide track (410). Consequently, any extrusions that exceed the restricted height of the passage between the pen guide track (410) and the backwards installation member (430) will experience an interference with the backwards installation member (430) upon insertion. This feature allows for the fool proofing of backward insertion of pens by customers.

Figure 12:
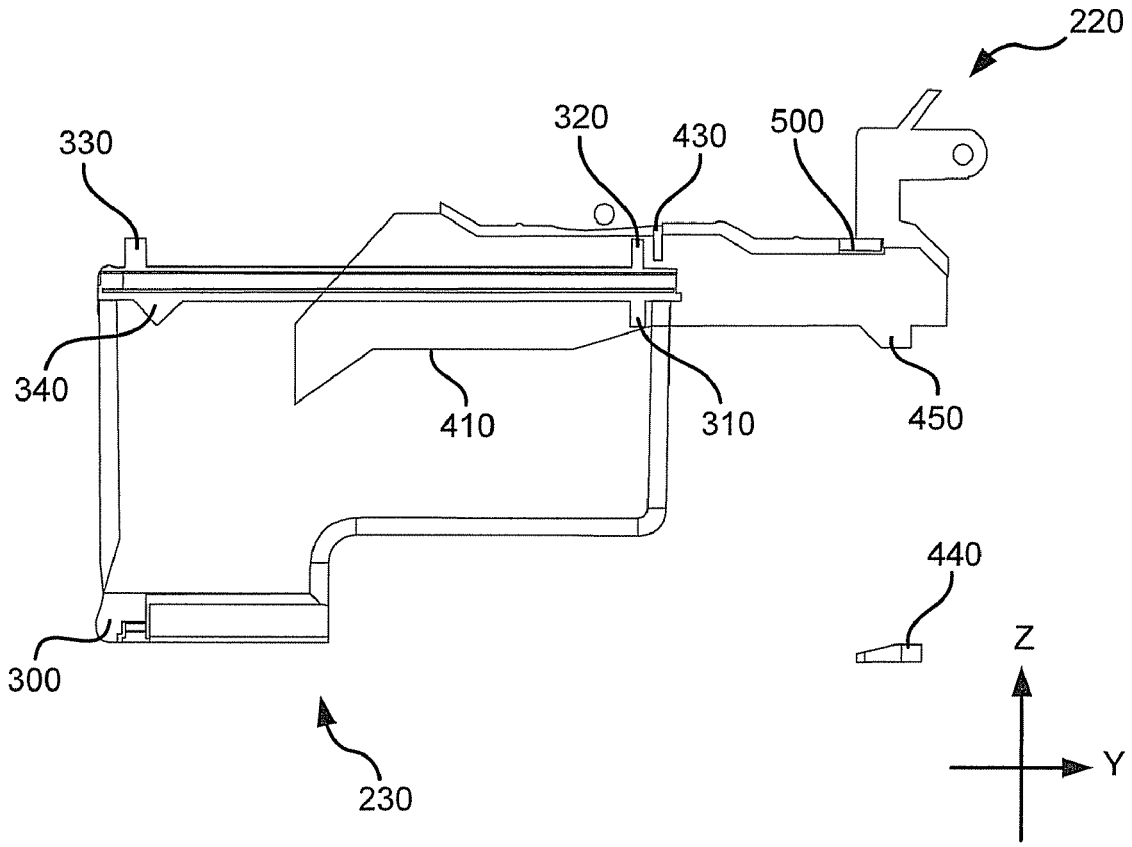
FIG. 12 is a side view illustrating an exemplary method for preventing the backwards insertion of an inkjet pen.

FIG. 12 illustrates how the restricted passage height created by the backwards installation member (430) works in conjunction with the backwards insertion stop (320) and the backward insertion member (310) to prevent the potentially damaging backwards insertion of an inkjet pen (230). As illustrated in FIG. 12, the backwards insertion stop (320) and the backward insertion member (320) of the exemplary inkjet pen (230) have a combined height that substantially exceeds the restricted height of the passage between the pen guide tack (410) and the backwards installation member (430). Consequently, when the exemplary inkjet pen is inserted as illustrated in FIG. 12, the backward insertion member (310) follows the pen guide track (410), forcing the backwards insertion stop (320) into an interference with the backwards installation member (430). The interference will provide a user with immediate feedback that the inkjet pen (230) is not oriented properly to be inserted into the exemplary carriage assembly (220) and must consequently be removed and reversed prior to insertion (step 730; FIG. 7).

Returning again to FIG. 9, if a properly oriented inkjet pen (230) is placed in contact with the restricted passage height created by the backwards installation member (430), the offset and relative height of the color keying member (340) and the color keying stop (330) will be configured to pass by the restricted passage height without interference as the color keying member (340) traces the profile of the pen guide track (410). This will allow the inkjet pen (230) to freely advance to the color key extrusion (500) portion of the carriage assembly (step 740; FIG. 7).

Figure 10:
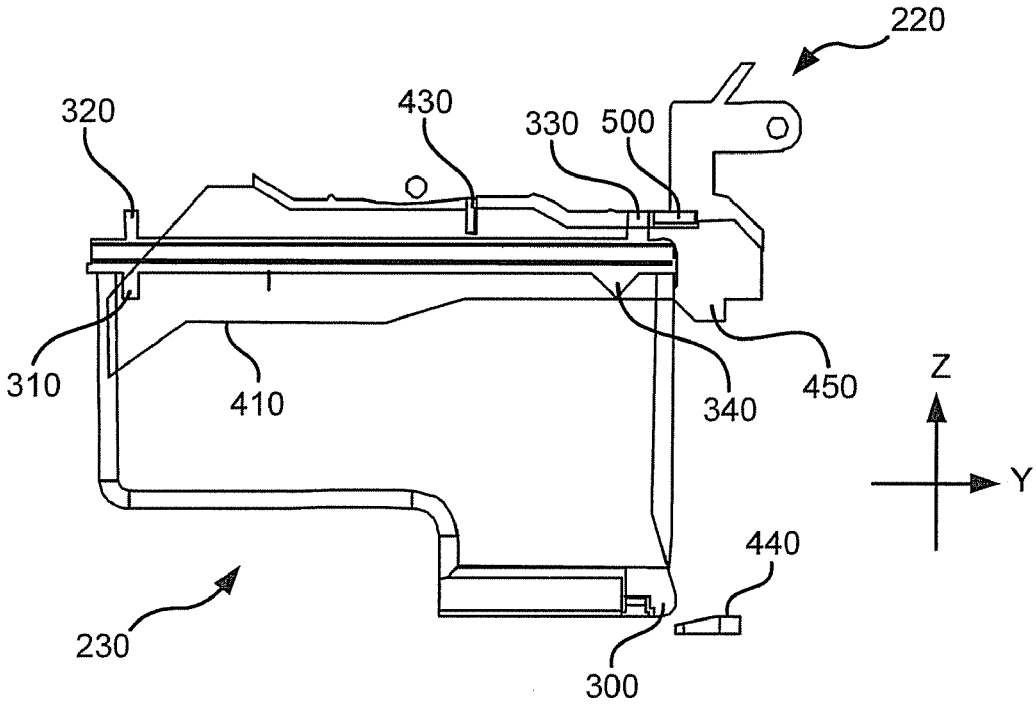
FIG. 10 is a side view illustrating an exemplary method for inserting an inkjet pen into an exemplary carriage assembly.

As illustrated in FIG. 10, the inkjet pen (230) is advanced so as to place the color keying stop (330) adjacent to the color key extrusion (500). As the inkjet pen (230) approaches the color key extrusion (500), the height and placement of the color keying stop (330) relative to the color keying member (340) and the location of the color key extrusion (500) with respect to the color keying track depression (450) will dictate whether the inkjet pen will be permitted to be fully inserted into the exemplary carriage assembly (220). As previously mentioned, inkjet pens having varying colors will have analogous varying configurations of the color keying stop (330) and the color keying member (340). Similarly, the carriage assemblies (220) configured to receive the varying color pens will have varyingly positioned color keying stops (330) and color key extrusions (500).

As illustrated in FIG. 10, if an inkjet pen (230) containing a wrong color of fluid is inserted into the exemplary carriage assembly (220), a color keying stop (330) will contact the color key extrusion (500) portion of the carriage assembly (220) before the color keying member is allowed to submerge into the color keying track depression (450). This interference between the color key extrusion (500) and the color keying stop (330) will prevent complete insertion of the inkjet pen (NO, step 750; FIG. 7) containing a wrong color. The interference between the color key extrusion (500) and the color keying stop (330) will provide immediate feedback to the user clearly indicating that the inkjet pen (230) being inserted into the carriage assembly (220) is not a correct color or type. As a result, the user will know that a different pen should be selected (step 760; FIG. 7). However, if the height and placement of the color keying stop (330) relative to the color keying member (340) correspond to the location of the color key extrusion (500) with respect to the color keying track depression (450), the inkjet pen will easily advance past the color keying feature (YES, step 750; FIG. 7) without interference and be readily positioned onto the carriage datum features (440).

Also illustrated in FIG. 10, as the inkjet pen (230) is advanced along the pen guide track (410) in the positive Y direction, the pen is elevated in the positive Z direction. As illustrated, a number of inclines are formed in the profile of the inwardly extruding guide track (410). As the color keying member (340) is translated across the profile of the inwardly extruding guide track (410) in the positive Y direction, the entire inkjet pen (230), including the Y datum feature (300), is elevated in the positive Z direction. As illustrated in FIG. 10, the increased elevation of the inkjet pen (230) allows the Y datum feature (300) to be transported up and over corresponding carriage datum features (440) until the inkjet pen is seated in the color keying track depression (450).

Figure 11:
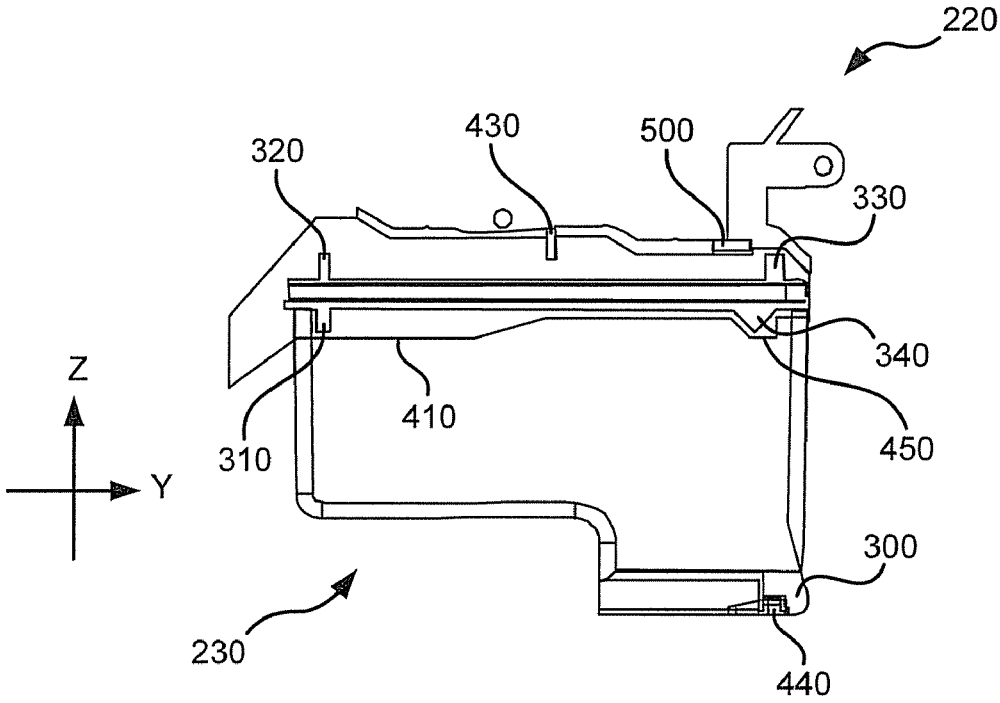
FIG. 11 is a side view illustrating an exemplary pen inserted in an exemplary carriage assembly.

FIG. 11 illustrates an exemplary inkjet pen (230) correctly seated in the color keying track depression (450). As shown, when the color keying member (340) drops into the color keying track depression (450), the Y datum feature (300) receives the carriage datum (440). According to the exemplary carriage assembly (220) shown in FIG. 11, by seating the Y datum feature (300) onto the carriage datum features (440), correct and secure placement of the inkjet pen (220) is assured.

In conclusion, the present system and method allow the customer to install the pen with one smooth frontward motion. Additionally, if a wrong pen is being inserted into a carriage, and/or the carriage is being installed with an erroneous orientation, the customer receives immediate feedback, in the form of a physical stop, indicating that the pen is being inserted in an inappropriate manner. This immediate feedback is provided to the user before the pen can be plugged into a cavity, thereby preventing a potentially damaging result.

The preceding description has been presented only to illustrate and describe exemplary embodiments of the present system and method. It is not intended to be exhaustive or to limit the system and method to any precise form disclosed. Many modifications and variations are possible in light of the above teaching. It is intended that the scope of the system and method be defined by the following claims.

What is claimed is:

1. An inkjet pen, comprising:

an internal ink supply; and at least one datum feature configured to engage and slide over a guide track in a pen carriage during installation of said pen in said carriage;

said at least one datum feature being configured to interact with corresponding datum features of said guide track to prevent improper installation of said pen in said carriage;

wherein said at least one datum feature further comprises a color keying member corresponding to a color of ink in said ink supply;

wherein said color keying member is configured to slide over said guide track during installation of said pen in said carriage.

2. The inkjet pen of claim 1, wherein said at least one datum feature comprises a backward insertion datum, said backward insertion datum resisting movement of said inkjet pen along said guide track if said inkjet pen is being inserted backwards into said carriage.

3. The inkjet pen of claim 2, wherein said backward insertion datum comprises a backward insertion member configured to slide over said guide track.

4. The inkjet pen of claim 3, wherein said backward insertion datum further comprises a backward insertion stop establishing a backwards datum height from a bottom of said backward insertion member to a top of said backward insertion stop, said backward datum height being sufficiently large to prevent further movement of said inkjet pen along said guide track if said inkjet pen is being inserted backwards into said carriage.

5. The inkjet pen of claim 1, wherein said ink supply comprises either colored or black ink.

6. The inkjet pen of claim 1, further comprising a color keying stop extending above said color keying member, wherein said color keying stop is configured to interfere with a datum of said guide track and prevent further movement of said pen along said guide track if a color of said ink in said ink supply does not correspond to a color to be provided using said carriage.

7. The inkjet pen of claim 1, wherein said color keying member is configured to be engaged in a color keying depression of said guide track if a color of said ink in said ink supply corresponds to a color to be provided using said carriage.

8. The inkjet pen of claim 1, further comprising a datum feature configured to slide over and then engage an inclined carriage datum feature of said carriage to prevent further movement of said inkjet pen in an insertion direction.

9. An inkjet pen, comprising:

an internal ink supply; and a plurality of datum features formed on said inkjet pen;

wherein said datum features are configured to interfere with corresponding datum features on a carriage of a printing device so as to prevent an attempt to install said pen backwards into said carriage of said printing device;

wherein said datum features comprise a backward insertion datum, said backward insertion datum resisting movement of said inkjet pen along a guide track of said carriage if said inkjet pen is being inserted backwards into said carriage.

10. The inkjet pen of claim 9, wherein said backward insertion datum comprises a backward insertion member configured to slide over said guide track.

11. The inkjet pen of claim 10, wherein said backward insertion datum further comprises a backward insertion stop establishing a backwards datum height from a bottom of said backward insertion member to a top of said backward insertion stop, said backward datum height being sufficiently large to prevent further movement of said inkjet pen along said guide track if said inkjet pen is being inserted backwards into said carriage.

12. An inkjet pen, comprising:

an internal ink supply; and a plurality of datum features formed on said inkjet pen;

wherein said datum features comprise a color keying member corresponding to a color of ink in said ink supply;

wherein said color keying member is configured to slide over a guide track in a carriage of a printing device during installation of said pen in said carriage.

13. The inkjet pen of claim 12, wherein said ink supply comprises either colored or black ink.

14. The inkjet pen of claim 12, wherein said datum features further comprise a color keying stop extending above said color keying member, wherein said color keying stop is configured to interfere with a datum of said guide track and prevent further movement of said pen along said guide track if a color of said ink in said ink supply does not correspond to a color to be provided using said carriage.

15. The inkjet pen of claim 12, wherein said color keying member is configured to be engaged in a color keying depression of said guide track if a color of said ink in said ink supply corresponds to a color to be provided using said carriage.

16. The inkjet pen of claim 12, further comprising a datum feature configured to slide over and then engage an inclined carriage datum feature of said carriage to prevent further movement of said inkjet pen in an insertion direction.

* * * * *